US010365053B2

(12) United States Patent
Billings

(10) Patent No.: US 10,365,053 B2
(45) Date of Patent: Jul. 30, 2019

(54) APPARATUS AND ASSOCIATED METHODS FOR CLEANING HVAC SYSTEMS

(71) Applicant: Danny Billings, Clemmons, NC (US)

(72) Inventor: Danny Billings, Clemmons, NC (US)

( * ) Notice: Subject to any disclaimer, the term of this patent is extended or adjusted under 35 U.S.C. 154(b) by 0 days.

(21) Appl. No.: 15/095,687

(22) Filed: Apr. 11, 2016

(65) Prior Publication Data

US 2017/0292802 A1 Oct. 12, 2017

(51) Int. Cl.

| | |
|---|---|
| ***F28G 1/16*** | (2006.01) |
| ***F28G 15/00*** | (2006.01) |
| ***F24F 1/14*** | (2011.01) |
| ***G08B 3/02*** | (2006.01) |
| ***B08B 3/08*** | (2006.01) |
| ***B08B 3/02*** | (2006.01) |
| ***B05B 13/02*** | (2006.01) |
| ***B05B 15/60*** | (2018.01) |
| *F28D 21/00* | (2006.01) |

(52) U.S. Cl.

CPC ..... *F28G 1/166* (2013.01); *B05B 13/0278* (2013.01); *B05B 15/60* (2018.02); *B08B 3/02* (2013.01); *B08B 3/08* (2013.01); *F24F 1/14* (2013.01); *F28G 15/003* (2013.01); *F24F 2221/225* (2013.01); *F28D 2021/007* (2013.01)

(58) Field of Classification Search

CPC . B08B 3/02; B08B 3/08; F28G 15/003; F28G 1/166; F24F 1/14

See application file for complete search history.

(56) References Cited

U.S. PATENT DOCUMENTS

| | | | | | |
|---|---|---|---|---|---|
| 4,141,754 | A * | 2/1979 | Frauenfeld | F28G 9/005 | 134/102.1 |
| 4,562,885 | A * | 1/1986 | Pausch | F28G 1/166 | 15/318.1 |
| 4,884,416 | A * | 12/1989 | Hwang | F24F 1/027 | 165/95 |
| 5,117,644 | A * | 6/1992 | Fought | F24F 1/06 | 62/171 |
| 5,186,240 | A * | 2/1993 | Kennon | F28G 3/166 | 134/172 |
| 5,279,357 | A * | 1/1994 | Kennon | F28G 3/166 | 122/391 |
| 5,605,052 | A * | 2/1997 | Middleton | F24F 5/0035 | 62/171 |
| 6,318,108 | B1 * | 11/2001 | Holstein | F24F 1/06 | 62/279 |
| 6,666,038 | B1 * | 12/2003 | Hynes | F24F 11/0086 | 62/171 |
| 6,978,793 | B1 * | 12/2005 | Krueger | F28F 3/083 | 134/109 |

(Continued)

*Primary Examiner* — Michael E Barr
*Assistant Examiner* — Benjamin L Osterhout
(74) *Attorney, Agent, or Firm* — Ben Schroeder Law PLLC

(57) ABSTRACT

An apparatus is disclosed that is designed to be able to clean HVAC condensers. The apparatus comprises a plurality of pipes that facilitates the passage of water through them allowing water and/or a cleaning solution to clean the condenser by spraying the condenser with sprayers without having to move the apparatus. The apparatus is designed so as to be able to spray every part of the condenser without having to move the apparatus. The apparatus may also have a timer associated with it that allows the condenser to be cleaned at periodic intervals.

20 Claims, 10 Drawing Sheets

(56) References Cited

U.S. PATENT DOCUMENTS

| | | | | |
|---|---|---|---|---|
| 7,207,182 | B1 * | 4/2007 | Schoonover | F24F 5/0035 62/171 |
| 7,234,316 | B2 * | 6/2007 | Tien | F24F 1/28 62/305 |
| 2014/0041834 | A1 * | 2/2014 | Kloeppner | F28F 1/00 165/104.13 |
| 2015/0144303 | A1 * | 5/2015 | Burfeind | F28G 1/166 165/95 |

* cited by examiner

APPARATUS AND ASSOCIATED METHODS FOR CLEANING HVAC SYSTEMS

FIELD OF THE INVENTION

The present invention relates to an apparatus and associated methods for cleaning HVAC systems. In one embodiment, the apparatus and methods are used for the cleaning of outdoor condensers that are part of an HVAC system. One method of use relates to the method of cleaning condensers of HVAC systems wherein the condenser contains either salt, or some other contaminant or pollutant.

BACKGROUND OF THE INVENTION

With the advent of houses and the movement of hominids from living outside to living inside, hominids have been concerned with heating and cooling their abodes. Initially, hominids used fire and wind to heat and cool their homes. Subsequently other methodologies have been employed. Although man has used many methods of trying to heat and cool their homes, the modern HVAC (heating, ventilating and air conditioning) system as we currently know it and the technologies associated therewith were largely developed in the 1900s.

Man has also had a desire to live in environments that are more hospitable to life. In certain locales, the environment may be warm or hot, so man might desire to reduce any discomfort by moving close to the sea, where the environment may be cooler and windier. In the winter months, the sea may provide a warming effect. Thus, the environment by the sea tends to be more temperate year round than locales that are inland. These environments, however, have the drawback of also being hard on man-made apparatuses. For example, although the interior of the houses may be heated, ventilated and cooled by an HVAC system, the condenser and other aspects of the HVAC system may reside outside. Because of the close proximity to the sea, the air surrounding houses close to the sea tends to have salt in the air. This salt tends to be corrosive to metal objects, such as condensers. Periodic cleaning of the HVAC systems may reduce the salt that contacts the condensers. Condensers that reside nearby buildings that extinguish smoke or other pollutants may build up soot or other pollutants on them and also periodically need to be cleaned. The building owners and homeowners might not have the time to clean their condensers by using a hose and/or buckets. This may be the case particularly where the house at the sea is a second residence for the homeowner. Thus, it is desired that an apparatus and methods that can be used to clean HVAC systems be procured that may happen automatically and has other useful advantages.

BRIEF SUMMARY OF THE INVENTION

The present invention relates to an apparatus that is designed to clean outdoor condensers. In an embodiment, the apparatus is designed to clean the condenser with water or some other cleaning liquid. In embodiments, methods of cleaning condensers by the apparatus of the present invention are contemplated. The apparatus in an embodiment is ideally suited to cleaning a condenser that has salt, soot, or some other pollutant on it.

DETAILED DESCRIPTION OF THE INVENTION

Figure 1:
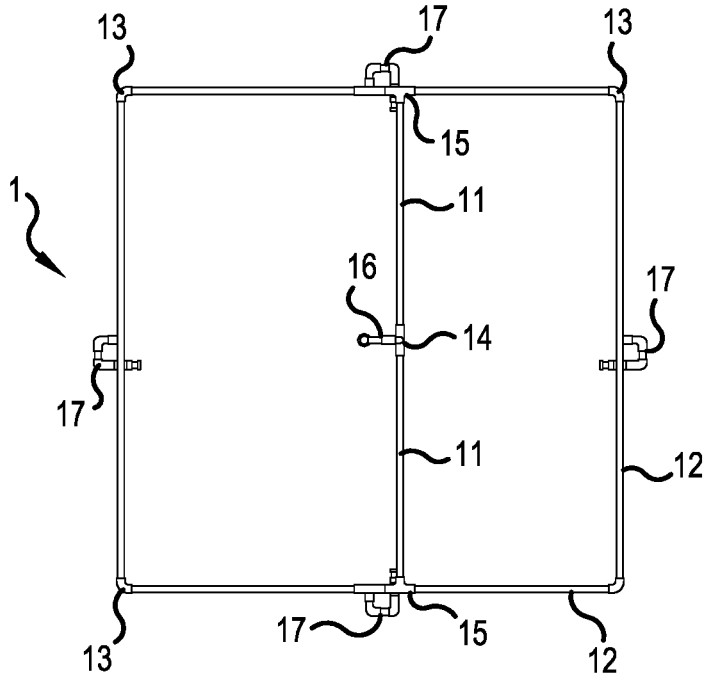
FIG. 1 shows top down view of the apparatus.

The present invention relates to an apparatus that is designed to clean HVAC systems, such as, for example, outdoor condensers. In an embodiment, the apparatus is designed to clean the condenser with water or some other cleaning liquid. In one embodiment, the cleaning liquid is Salt-Away. In an embodiment, the cleaning liquid is Salt & Corrosion Terminator. The apparatus, in one embodiment, is designed to remove salt from the condenser. However, it should be recognized that the apparatus can also be used to remove and/or reduce rust such as by using in conjunction with water a product like Metal Blast.

Although the apparatus of the present, invention is ideally suited to cleaning condensers, it should be recognized that the apparatus of the present invention can be used to clean any of a plurality of devices that are outside. Non limiting examples would include ice machine, roof top exhaust fans, and/or generators.

In an embodiment, the present invention relates to an apparatus that comprises at least one pipe wherein water or some other liquid can enter said at least one pipe, pass through the at least one pipe and be expelled at a location that is designed so that it is proximal to the condenser.

In an embodiment, the apparatus is ideally suited for cleaning a condenser on an HVAC system. In an embodiment, the apparatus comprises a plurality of pipes, the plurality of pipes being assembled in a manner that the apparatus is ideally suited to deliver water or a cleaning liquid to the condenser at a pressure sufficient to clean the condenser. In an embodiment, the plurality of pipes have at least one inlet that allows water to transverse the interior of said plurality of pipes and at least one outlet, the at least one outlet positioned so as to deliver the water or the cleaning liquid to every part oldie condenser without moving the apparatus.

Thus, in one embodiment, the plurality of pipes is assembled to generate an apparatus so that the plurality of pipes circumnavigates the entire condenser. That is, the plurality of pipes is assembled so that they are positioned on every side of the condenser so that water or a cleaning liquid that passes through the pipes is able to wash every side of the condenser (including all sides and the top of the condenser). The assembled apparatus, in an embodiment has a plurality of outlets positioned at a plurality of locations that allows the water or cleaning liquid to spray every side of the condenser without having to move the condenser.

In one embodiment, the apparatus has an inlet that allows one to attach a hose or some other device to the inlet that allows a volume of water or a cleaning liquid to enter the inlet. The water than passes through the interior of the plurality of pipes until an outlet is reached by the water or cleaning liquid, where upon the water or cleaning liquid is expelled out the outlet to deliver water at a sufficient pressure so that it is able to clean the condenser. Because the apparatus is designed to clean the entire condenser without being moved, the apparatus in an embodiment, has pipes that are in close proximity to the condenser on all sides of the condenser (including the top but usually not the bottom). Couplings can be used (such as right angle couplings) to couple the plurality at pipes so that the pipes with their corresponding outlets can be positioned so that they can spray water or a cleaning liquid on every part of the condenser. The couplings are designed so that the plurality of pipes fit snuggly inside of them. In an embodiment, the couplings may allow the joining together of two or three, or four, or five pipes together.

In an embodiment, the plurality of pipes may be PVC (poly vinylchloride) pipes. Alternately and/or additionally, the plurality of pipes may be PVC, APS (acrylonitrile butadiene styrene), CPVC (chlorinated polyvinyl chloride), PE (polyethylene), PEX (Cross linked polyethylene), TIPS (thermoplastic industrial piping system), or mixtures thereof. The plurality of pipes may alternately be copper pipes, or cast iron, or mixtures thereof, or mixtures of plastic and metal pipes.

In an embodiment, the diameter of the plurality of pipes may be between about ⅛ inch and 3 inches, or mixtures of various diameter sires. In an embodiment, the plurality of pipes used may be ⅛ inch, ¼ inch, ⅜ inch, ½ inch, ⅝ inch, ¾ inch, ⅞ inch, 1 inch, 1¼ inch, 1½ inch, 1¾ inch, 2 inch, 2½ inch, or 3 inch, or mixtures of any of these sizes. In an embodiment, the diameter of the plurality of pipes is chosen so as to have ideal water pressure to allow sufficient pressure to be generated when the water or cleaning liquid sprays out the one or more outlets. When the volume of water remains constant, the pressure increases with a decreased diameter of pipe used. Thus, in one embodiment, the inlet and pipes that are traversed earlier (those pipes closer to the inlet), the diameter of a pipe may be larger and get subsequently smaller as the water traverses through the apparatus. This is one way that the pressure of water being released from an outlet stays uniform throughout the apparatus.

In an embodiment, the inlet may have a valve that occurs prior to or after the inlet (or in both locations) that allow a user to stop the water or cleaning solution from entering the apparatus or a part of the apparatus. In one embodiment, valves may be positioned so as, to allow water to only traverse certain parts of the apparatus and stop it from traversing other parts). These valves may be added so that one can increase water or cleaning liquid pressure that is released from certain parts of the apparatus without being released from other parts. That is, the volume of water In one embodiment, the present invention relates to a kit that contains at least a plurality of pipes and couplings. The kit may also optionally contain components to serve as sprayers and as an inlet. The kit may also optionally contain an adhesive that allows the plurality of pipes to be more or less permanently connected to the couplings allowing the plurality of pipes to be joined together to them the apparatus. In an embodiment, the kit can be specially prepared for the condenser that is to be cleaned. For example, if the condenser is a large condenser, the pipes may be longer so as to accommodate a larger condenser. Moreover, more sprayers may be present on each side so as to accommodate the cleaning of a larger condenser.

The invention will now be described with reference to the figures. This description is not to be limiting but rather is merely illustrative of apparatuses and methods of the invention may operate.

FIG. 1 shows top down view of the apparatus 1. In this figure, a plurality of pipes 11 and 12 are connected together by couplings 13, 14, and 15. Sprayers 16 and 17 are also part of the apparatus 1. In FIG. 1, center sprayer 16 is positioned so that it is at essentially the same level as top central pipes 11. Side sprayers 17 are positioned so that they are below the plurality of pipes 11 and 12 that are at the top of the apparatus 1. That is, side sprayers 17 are positioned so that they can spray the sides of a condenser (not shown in FIG. 1 but can be seen in FIG. 15). As can be seen in FIG. 1, the corner couplings 13 are right angle couplings that allow for example, three pipes to be connected at right angles to each other. Center coupling 14 is a tee (T) shaped coupling that allows a center sprayer 16 to be connected to two essentially parallel pipes 11. Side couplings 15 are also tee shaped couplings that allow two pipes to be connected to each other in an essentially parallel manner and an additional pipe to be connected to the side couplings 15 in a perpendicular (right) angle manner from the parallel pipes. Thus, the tee shaped couplings either have three pipes connected to them or two pipes and a sprayer connected to them.

Figure 2:
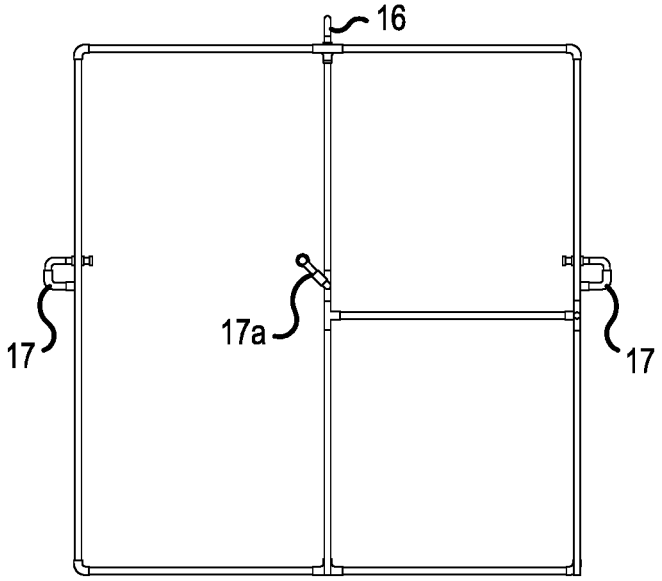
FIG. 2 shows right side view of the apparatus

FIG. 2 shows a right side view of one embodiment of the apparatus. In FIG. 2, it can be seen that side sprayers 17 and 17*a* are designed to spray the sides of the condenser (in this instance, three of the sides of the condenser) and center sprayer 16 is designed to spray the top of the condenser.

Figure 3:
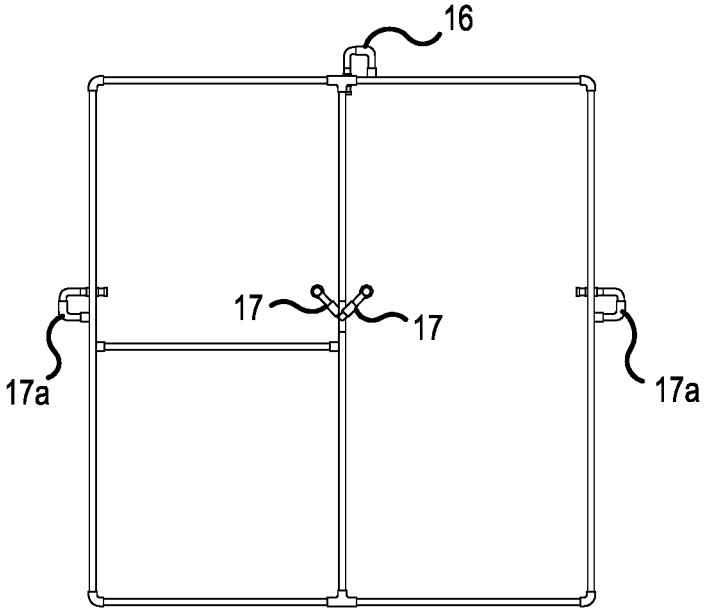
FIG. 3 shows a front view of the apparatus.

FIG. 3 shows a front view of one embodiment of the apparatus. In FIG. 3, it can be seen that side sprayers 17 and 17*a* are designed to spray the sides of the condenser (in this instance, all four of the sides of the condenser) and center sprayer 16 is designed to spray the top of the condenser.

Figure 4:
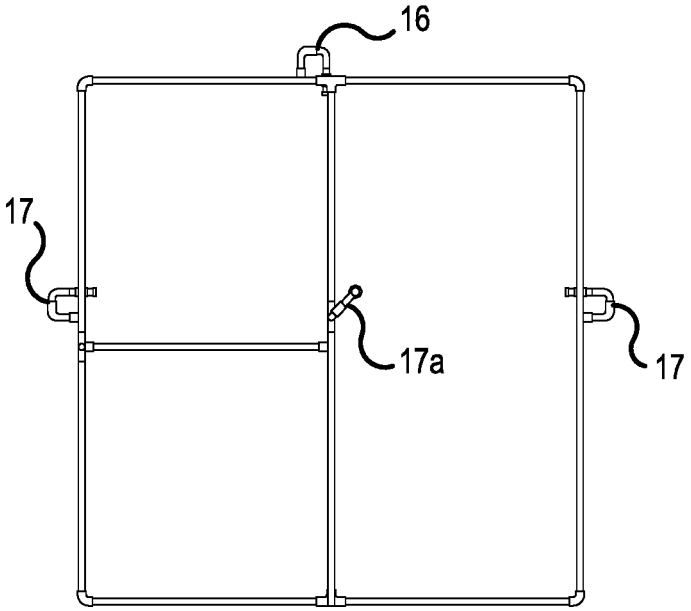
FIG. 4 shows a rear view of the apparatus.

FIG. 4 shows a left side view of one embodiment of the apparatus. In FIG. 4, it can be seen that side sprayers 17 and 17*a* are designed to spray the sides of the condenser (in this instance, three of the sides of the condenser) and center sprayer 16 is designed to spray the top of the condenser.

Figure 5:
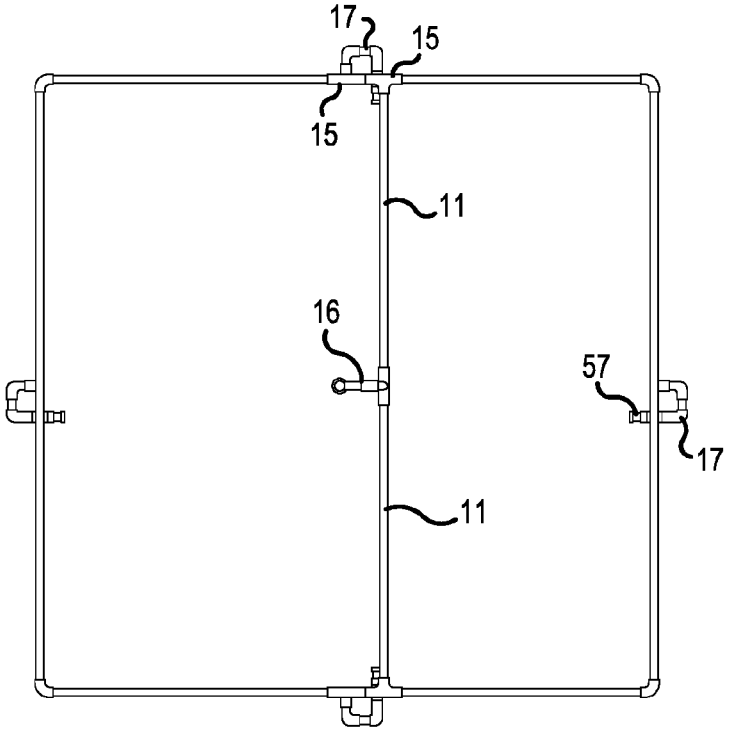
FIG. 5 shows another top down view of the apparatus.

FIG. 5 shows another top down view of the apparatus. FIG. 5 is a larger version of FIG. 1. In FIG. 5, side sprayer 17 and center sprayer 16 optionally have attachments 57 (not shown in connection with center sprayer 16) that allows the spray to be adjusted so that the width of the spray coming from the sprayer can be adjusted. By turning attachment 57, the width is of the spray emanating from the sprayer goes from a focused column of spray to a range of cones spray sizes, thus allowing an individual to set the spray to cover the entire (or a part of) the condenser. In an alternate embodiment, attachment 57 might also serve as a valve to stop the flow of water from emanating from the sprayer. Also, in an embodiment, attachment 57 may be smaller in diameter than the piping in the apparatus, which means that the pressure coming from sprayer 17 is enhanced. In FIG. 5, in one embodiment, two tee couplings 15 are used allowing both a pipe 11 to go across the apparatus but also a pipe to go down to the bottom of the apparatus (not shown in FIG. 5 but can be better seen in FIG. 13).

Figure 6:
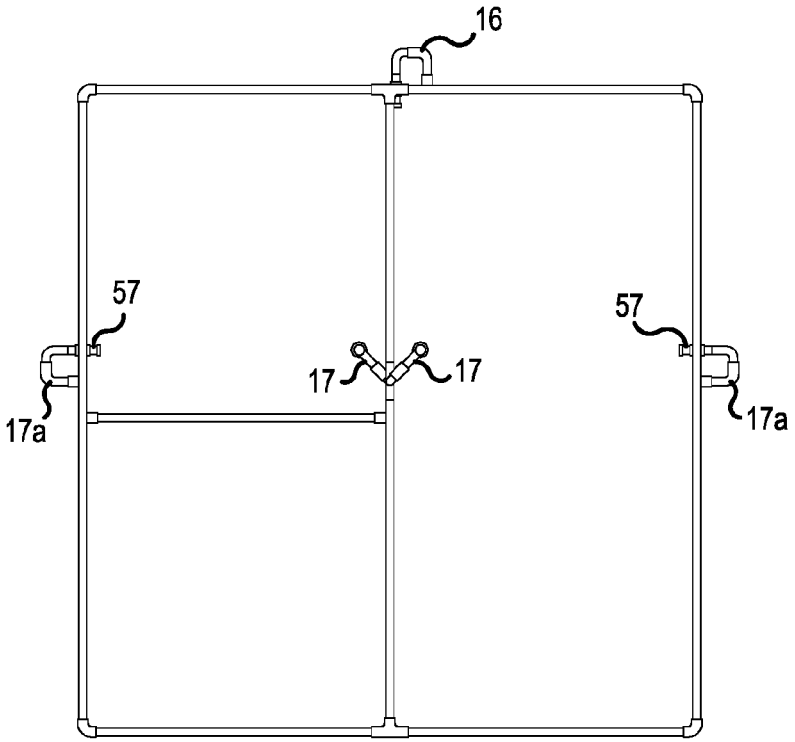
FIG. 6 shows another front view of the apparatus.

FIG. 6 shows a front view of one embodiment of the apparatus. In FIG. 6, one can again see the attachment 57 that is a part of sprayers 16, 17, and 17*a*. The attachment 57 functions as described above in connection with FIG. 5.

Figure 7:
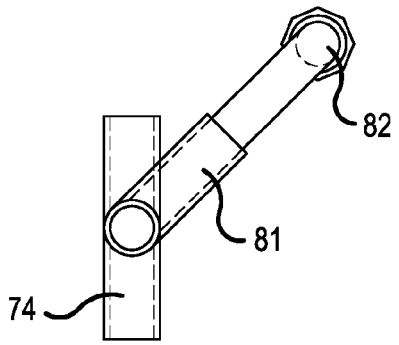
FIG. 7 shows a front view of a sprayer.

FIG. 7 shows a front view of a sprayer. In FIG. 7, there is a tee coupling 74 from which a first elbow pipe 81 emanates eventually leading to a second elbow pipe 82 allowing the sprayer to be positioned so that it can spray the condenser that rests in the center of the apparatus. The elbow pipes 81 and 82 can be better seen in FIG. 8.

Figure 8:
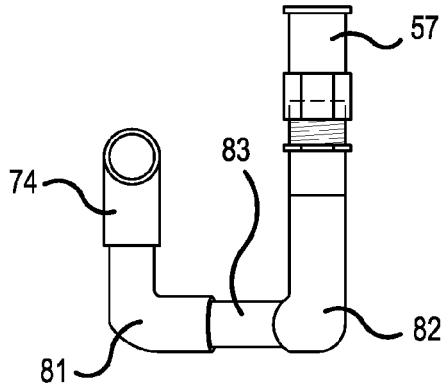
FIG. 8 shows a top down view of a sprayer.

FIG. 8 shows a top down view of a side sprayer 17. This configuration can be used for any of the sprayers. In FIG. 8, first elbow pipe 81 comes from the tee coupling 74. Straight pipe 83 acts to couple first elbow pipe 81 with second elbow pipe 82. In this figure, attachment 57 can be used to adjust the spray as described above in connection with FIG. 5.

Figure 9:
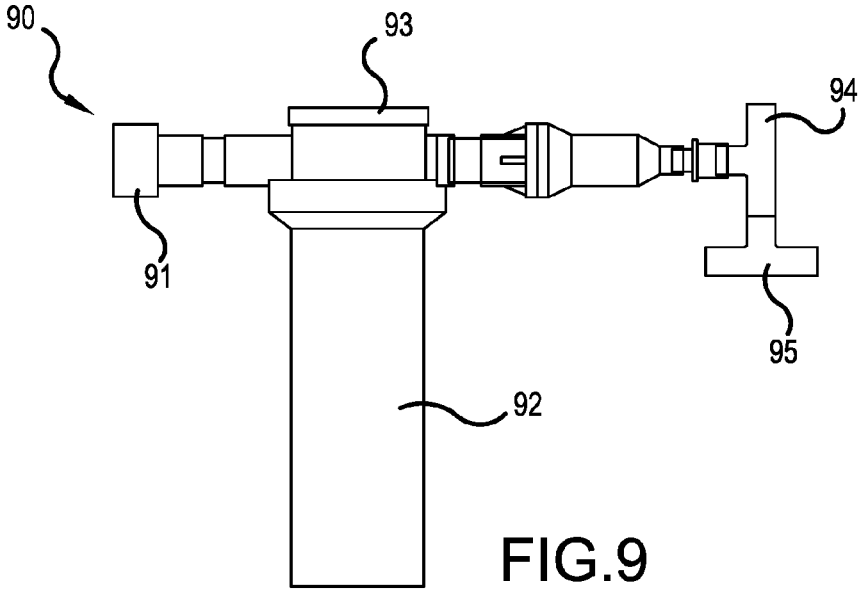
FIG. 9 shows a side view of the inlet of the apparatus.

FIG. 9 shows a side view of the inlet 90 of the apparatus. A threaded hose can be attached to entrance point 91 of the inlet 90. Inlet 90 also contains a container 92 that can accommodate a cleaning solution. In an embodiment, top 93 of container 92 can be removed to allow one to put a cleaning solution in container 92. As water passes from entrance point 91 to tee coupling 94 the passage of water pulls a cleaning solution from container 92 into the water stream allowing a mix of the cleaning solution and the water to be used to spray the condenser. In an alternate embodiment, one may be able to remove container 92 to place the cleaning solution in the container 92 and reattach it to the inlet 90. In an, embodiment, and as shown in FIG. 9, the tee coupling 94 may be attached to another tee coupling 95 allowing a plurality of pipes to be attached in many directions at the inlet 91.

Figure 10:
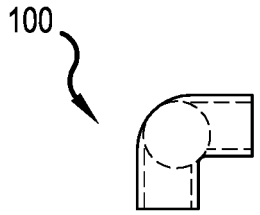
FIG. 10 shows a top down view of a right angle three pipe coupling.

FIG. 10 shows a top down view of a right angle three pipe coupling 100. This allows three pipes to be connected to each other at corners of the apparatus.

Figure 11:
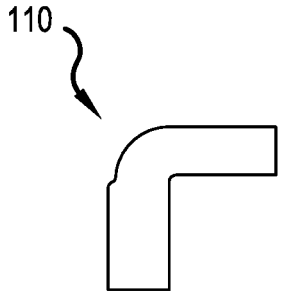
FIG. 11 shows a bottom down view of a right angle three pipe coupling.

FIG. 11 shows a bottom down view of a right angle two pipe coupling 110. This type of coupling can be used in the sprayers of the apparatus.

Figure 12:
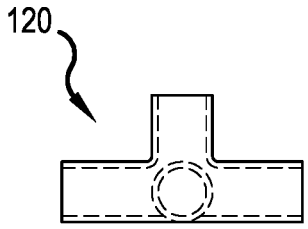
FIG. 12 shows a top down view of a tee four pipe coupling.

FIG. 12 shows a top down view of a tee four pipe coupling 120. In an embodiment of the invention, four distinct pipes (or three pipes and a sprayer) can be connected to this tee four pipe coupling. This type of coupling is generally used in the center top or bottom of the apparatus allowing two pipes to be essentially contiguous joined together) in a parallel direction to each other and two pipes to be perpendicular to the two contiguous pipes. This type of coupling can also be used to have three pipes joined together and a sprayer joined in the fourth opening of the coupling.

Figure 13:
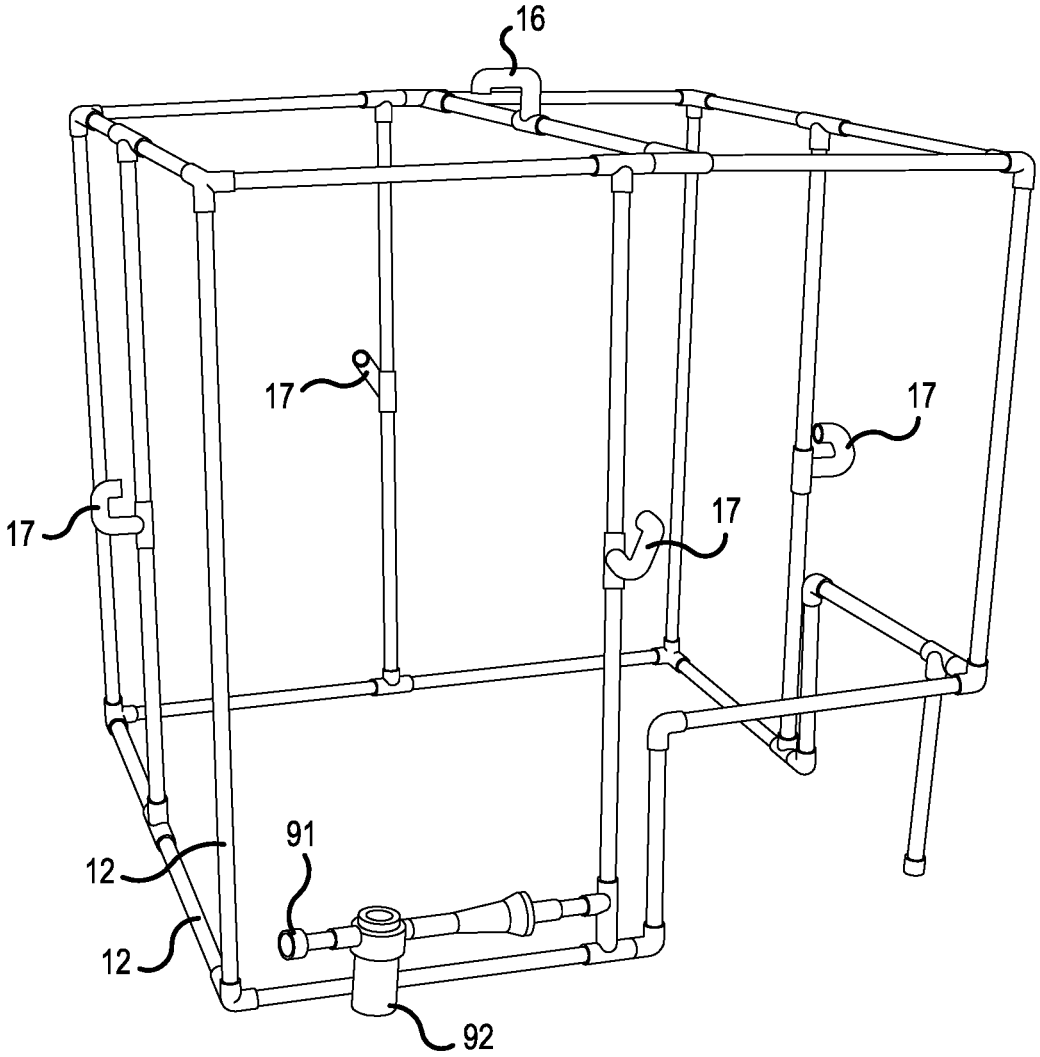
FIG. 13 shows a perspective view of one embodiment of the apparatus.

FIG. 13 shows a perspective view of one embodiment of the apparatus. In this figure, it can be seen that the sprayers 16 and 17 are able to sprayer the condenser on four sides and on the top simultaneously. Water enters at the entrance point 91 of inlet. Container 92 optionally can be loaded with a cleaning solution that can be mixed with the water entering the apparatus. The water is able to traverse from inlet through a plurality of pipes 12 and exit at the sprayers (outlets). Although not shown in the figure, it is contemplated that valves may be positioned in the middle of any one or more pipes stopping the flow of water down said one or more pipes.

Figure 14:
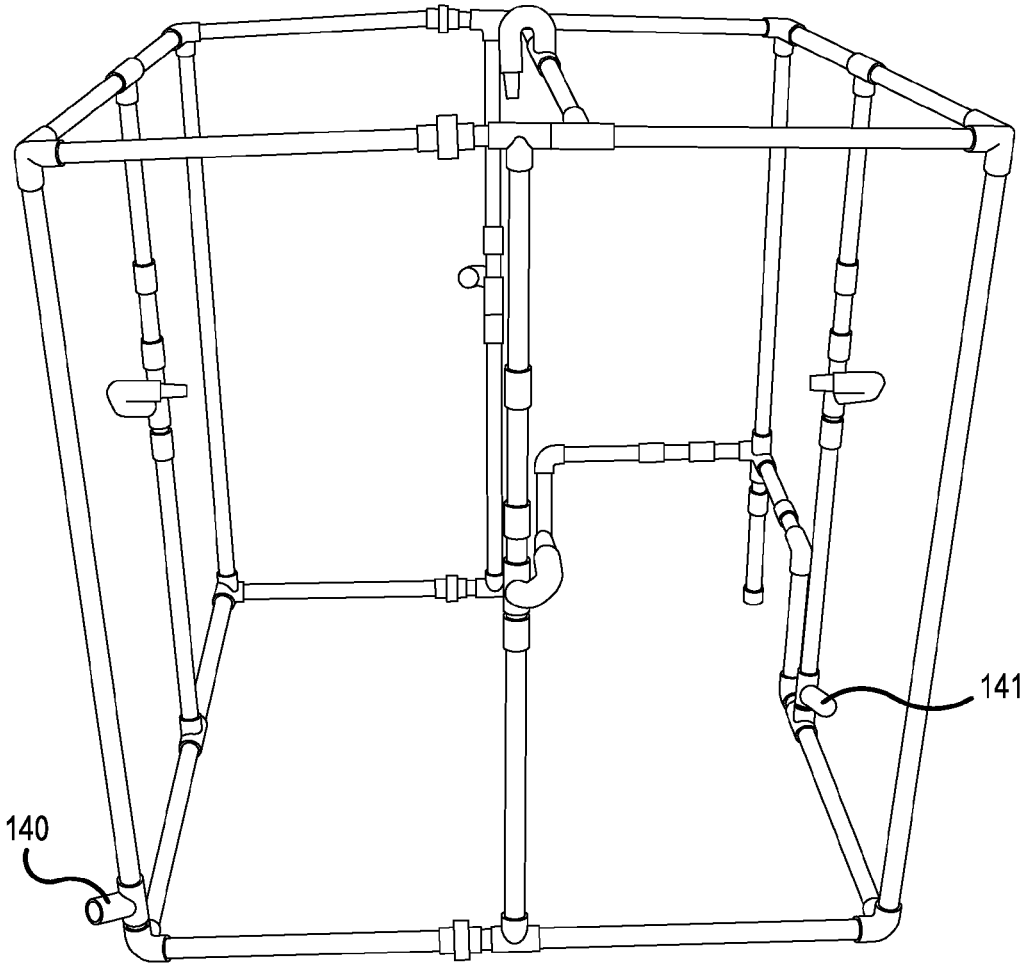
FIG. 14 shows a perspective view of one embodiment of the apparatus.

FIG. 14 shows a perspective view of one embodiment of the apparatus. In this figure, the inlet 140 is simpler that the inlet for example in FIG. 13 and also in a different position. That is, it does not have a container to accommodate a cleaning solution and it enters at a corner of the apparatus. The tee coupling 141 may be capped off.

Figure 15:
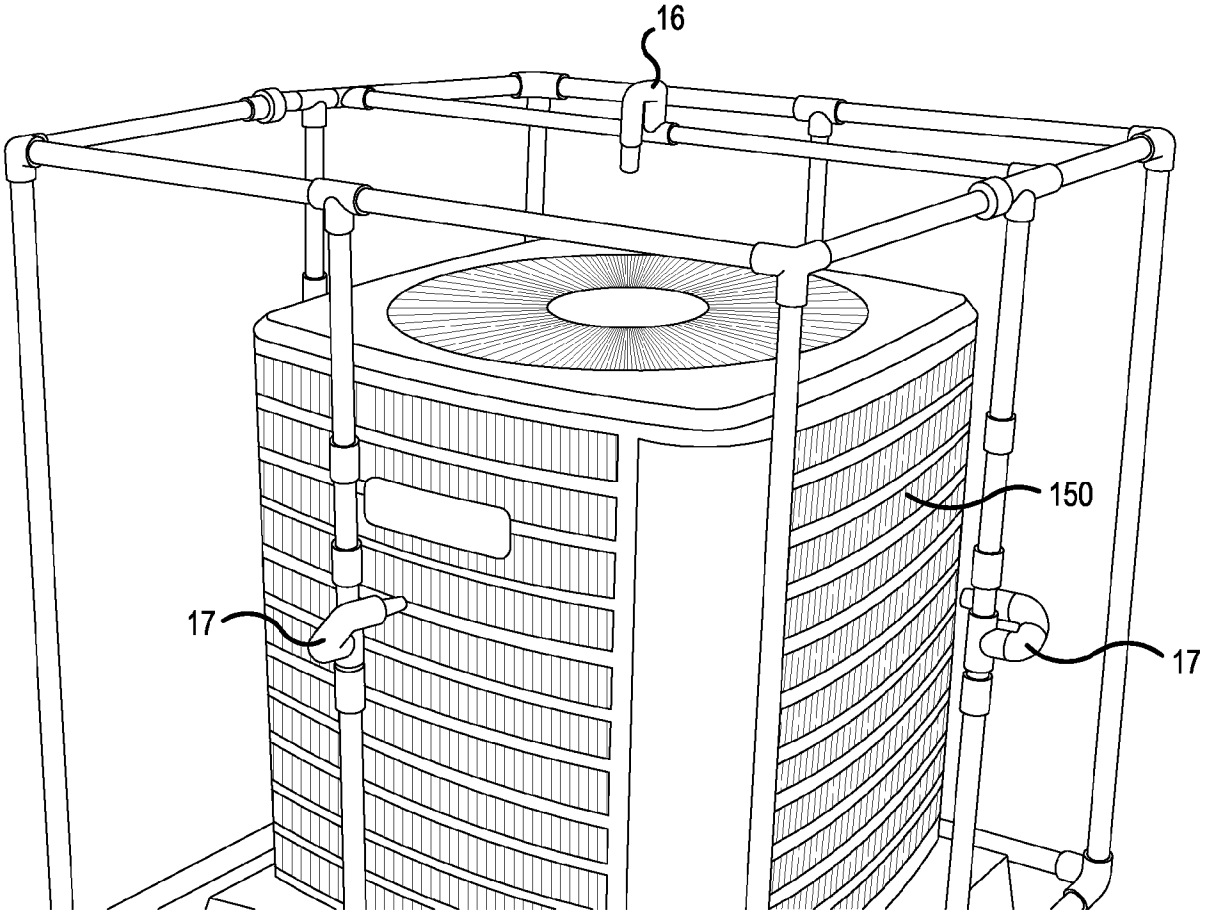
FIG. 15 shows a perspective view of one embodiment of the apparatus over a condenser.

FIG. 15 shows a perspective view of one embodiment of the apparatus over a condenser. In this figure, one should note that the sprayers 16 and 17 are positioned so as to be able to spray the condenser on all sides as well as the top, thereby cleaning the condenser 150.

Figure 16:
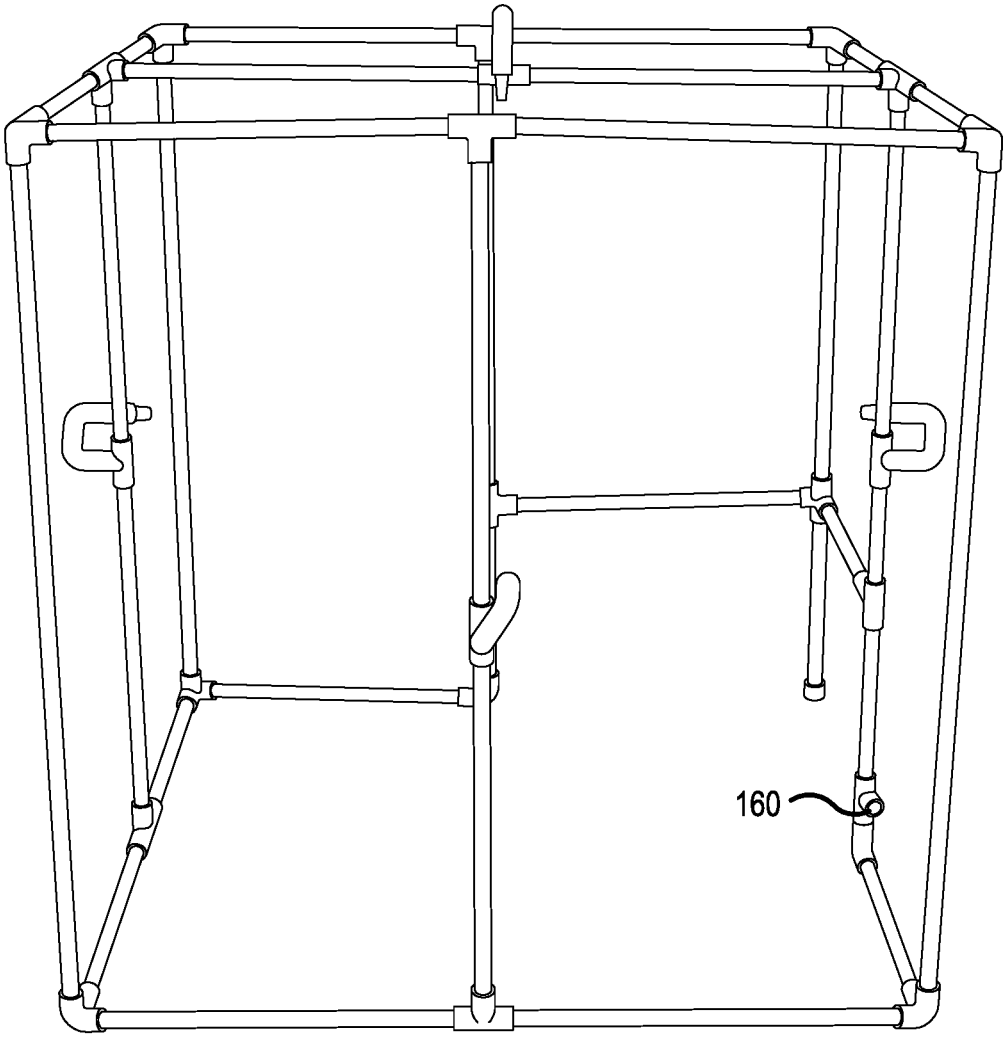
FIG. 16 shows a perspective view of another embodiment attic apparatus.

FIG. 16 shows, a perspective view of another embodiment of the apparatus. The inlet 160 is a simpler inlet in that it does not contain the container that is present in FIG. 13.

Figure 17:
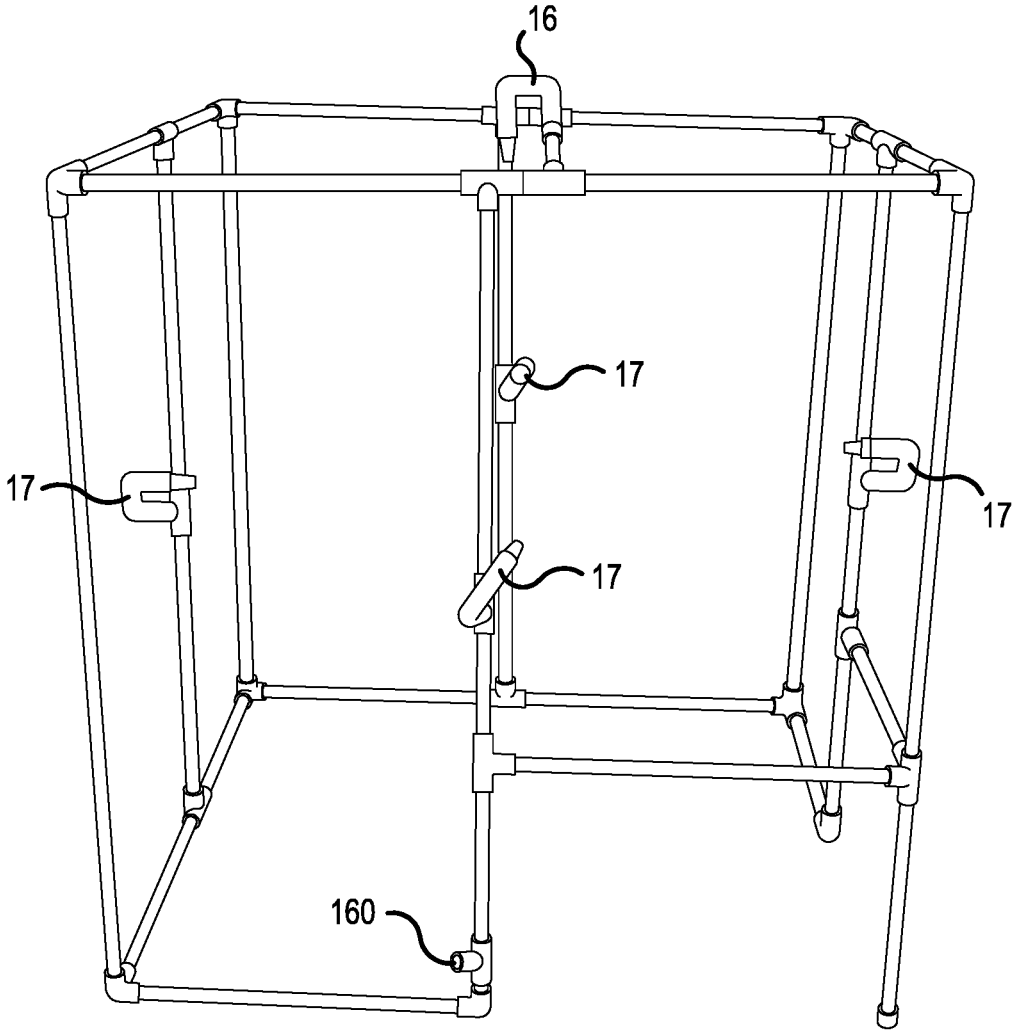
FIG. 17 shows a perspective view of another embodiment of the apparatus.

FIG. 17 shows a different perspective view of another embodiment of the apparatus. In this perspective drawing, the inlet 160 is the same as in FIG. 16. Moreover, one should note that sprayers 16 and 17 are positioned so as to be able to spray on all sides of the condenser as well as on the top of the condenser by sprayer 16.

Although all of the embodiments are shown with one sprayer on each side as well as the top of the apparatus, it should be understood that two or more sprayers may be present on each side of the apparatus. This may be particularly important in the case where a large condenser is to be cleaned, for example, the condensers that may be on the top of industrial buildings and/or factories.

In an embodiment, the present invention relates to an apparatus for cleaning a condenser on an HVAC system, said apparatus comprising a plurality of pipes, said plurality of pipes being assembled in a manner that the apparatus is ideally suited to deliver water and/or a cleaning liquid to the condenser at a pressure sufficient to clean the condenser, the plurality of pipes having at least one inlet that allows water to transverse the interior of said plurality of pipes and at least one sprayer, said at least one sprayer positioned so as to deliver the water and/or the cleaning liquid to every part of the condenser without moving the apparatus.

In an embodiment, the present invention relates to an apparatus for cleaning a condenser on an HVAC system, said apparatus comprising a plurality of pipes, said plurality of pipes being assembled in a manner that the apparatus is ideally suited to deliver water and/or a cleaning liquid to the condenser at a pressure sufficient to clean the condenser, the plurality of pipes having at least one inlet that allows water to transverse the interior of said plurality of pipes and at least one sprayer, said at least one sprayer positioned so as to deliver the water and/or the cleaning liquid to every part of the condenser without moving the apparatus, the plurality of pipes being joined by a plurality of couplings, the couplings comprising both tee couplings and right angle couplings, the couplings designed to accommodate the plurality of pipes.

In a variation, the apparatus comprises a plurality of sprayers. In a variation, the plurality of sprayers are positioned so that every side of the condenser as well as the top of the condenser receive spray. In an embodiment, the apparatus may be designed so that only three of four sides and the top of the condenser receive spray.

In a variation, the apparatus further comprises at least one valve that can shut off water to a part of the apparatus. In an embodiment, the apparatus comprises a plurality of valves. The plurality of valves can be used to either shut off water to a part of the apparatus or to change the volume of water and/or cleaning liquid that goes to the various sprayers.

In a variation of the invention, the inlet comprises a container designed to hold a cleaning liquid. The container is designed so that when water passes the container, the cleaning liquid mixes with the water thereby delivering water and cleaning liquid to all sides as well as the top of the condenser.

In one embodiment, the at least one sprayer further comprises at least one attachment that allows a spray emanating from the at least one sprayer to be shut off. In a variation, the at least one attachment can be adjusted so that a spray emanating therefrom can go from a streaming column to a cone shaped spray. The cone shaped spray can be adjusted so that an entire side of the condenser receives the spray.

In an embodiment, the at least one attachment has a diameter smaller than the plurality of pipes that deliver water and/or cleaning solution to the at least one sprayer. The smaller diameter allows the spray that emanates from the sprayers to be of a greater pressure than it would be if the attachment were larger.

In an embodiment, the plurality of pipes is one or more of poly vinylchloride, acrylonitrile butadiene styrene, chlorinated polyvinyl chloride, polyethylene, cross linked polyethylene, or thermoplastic industrial piping system or mixtures thereof. In an embodiment, the plurality of pipes are comprised of metal. In a variation, the metal may be copper, galvanized steel, stainless steel, or cast iron.

In an embodiment, the apparatus may further comprise at least one coupling, said at least one coupling designed to accommodate the plurality of pipes. That is the pipes can be inserted into the couplings. Moreover, sprayers may be inserted into the at least one coupling.

In an embodiment, the apparatus comprises a plurality of couplings. In a variation, the plurality of couplings comprises at least one tee coupling and at least one right angle coupling. The tee coupling is generally positioned in the center of a side of the apparatus and the right angle coupling is generally positioned so as to be present at a corner of the apparatus.

In an embodiment, the present invention relates to a kit that comprises parts for assembling an apparatus, said apparatus designed to clean a condenser on an HVAC system, said apparatus comprising a plurality of pipes, said plurality of pipes being assembled in a manner that the apparatus is ideally suited to deliver water, and/or a cleaning liquid to the condenser at a pressure sufficient to clean the condenser, the plurality of pipes having at least one inlet that allows water to transverse the interior of said plurality of pipes and at least one sprayer, said at least one sprayer positioned so as deliver the water and/or the cleaning liquid to every part of the condenser without moving the apparatus.

In a variation, the kit further comprises couplings and adhesive. The adhesive may be a cement that is designed for PVC. The kit may also comprise primer that is used prior to applying the cement.

In a variation, the kit may have couplings that comprise at least one tee coupling and at least one right angle coupling.

In a variation, the kit may also comprise a timer that allows a user to set the apparatus to automatically clean the condenser. The timer can be set so that the apparatus sprays the condenser at assigned times. Typically, the timer might be similar to a timer that is used on sprinkler systems used for landscaping (or lawns). The timer might have one or more valves associated with it that allows the passage of water at certain times. The timer may run on batteries, low voltage or line voltage.

In a variation, the kit can be modified to accommodate condensers of different sizes. That is, the owner of a condenser may be able to order a kit that has the kit parts that are ideally suited to clean the condenser that the owner owns. For example, the plurality of pipes may be shorter for a condenser that is smaller and longer for a condenser that is larger.

In an embodiment, the present invention relates to a method of cleaning a condenser that has salt and/or soot on the condenser, said method comprising placing an apparatus over the condenser, said apparatus designed to clean a condenser on an HVAC system, said apparatus comprising a plurality of pipes, said plurality of pipes being assembled in a manner that the apparatus is ideally suited to deliver water and/or a cleaning liquid to the condenser at a pressure sufficient to clean the condenser, the plurality of pipes having at least one inlet that allows water to transverse the interior of said plurality of pipes and at least one sprayer, said at least one sprayer positioned so as to deliver the water and/or the cleaning liquid to every part of the condenser without moving the apparatus thereby cleaning the condenser.

In a variation, the apparatus may have at least one valve that allows a user to shut of water to at least a part of the apparatus. Thus, the water that sprays the condenser can be adjusted.

In a variation, the method may further comprise using a cleaning solution to clean the condenser. The cleaning solution may be a composition that comprises, by weight, from about 2.25 to 2.75% of tetrasodium ethylenediamine tetraacetate dihydrate, about 9 to 11% of sodium nitrite, about 33 to 39% of water, about 9 to 11% of a nonionic surfactant, about 4.5 to 5.5% of sodium benzoate, about 14 to 18% of isopropanol and about 14 to 23% of methanol.

It should be understood that the present invention is not to be limited by the above description. Modifications can be made to the above without departing from the spirit and scope of the invention. It is contemplated and therefore within the scope of the present invention that any feature that is described above can be combined with any other feature that is described above (even if those features are not described together). Moreover, it should be understood that the present invention contemplates and it is therefore within the scope of the invention that any element that is described can be omitted from the apparatus and/or methods of the present invention. When a range is given, it is contemplated and therefore within the scope of the invention that subranges within the range are contemplated. Any real number that makes the subrange can be used as an end point to make a sub range. In any event, the scope of protection to be afforded is to be determined by the claims which follow and the breadth of interpretation which the law allows.

I claim:

1. An apparatus configurable for cleaning a condenser on an HVAC system, said apparatus comprising a plurality of pipes, said plurality of pipes being assembled in a manner that the apparatus is ideally suited to deliver water and/or a cleaning liquid to the condenser at a pressure sufficient to clean the condenser, the plurality of pipes having an inlet that allows water to transverse the interior of said plurality of pipes and at least one sprayer, said at least one sprayer positioned so as to deliver the water and/or the cleaning liquid to every part of the condenser without moving the apparatus, wherein the inlet comprises a container configured to be removable and reattachable and to hold a cleaning liquid that can be mixed with water entering the apparatus.

2. The apparatus of claim 1, wherein the apparatus comprises a plurality of sprayers.

3. The apparatus of claim 2, wherein the plurality of sprayers are positioned so that every side of the condenser as well as the top of the condenser receive spray.

4. The apparatus of claim 1, further comprising at least one valve that can shut off water to a part of the apparatus.

5. The apparatus of claim 4, wherein the apparatus comprises a plurality of valves.

6. The apparatus of claim 1, wherein the at least one sprayer further comprises at least one attachment that allows a spray emanating from the at least one sprayer to be shut off.

7. The apparatus of claim 6, wherein the at least one attachment can be adjusted so that a spray emanating therefrom can go from a streaming column to a cone shaped spray.

8. The apparatus of claim 7, wherein the at least one attachment has a diameter smaller than the plurality of pipes that deliver water and/or cleaning solution to the at least one sprayer.

9. The apparatus of claim 1, wherein the plurality of pipes is one or more of poly vinylchloride, acrylonitrile butadiene styrene, chlorinated polyvinyl chloride, polyethylene, cross linked polyethylene, or thermoplastic industrial piping system or mixtures thereof.

10. The apparatus of claim 1, wherein the plurality of pipes are comprised of metal.

11. The apparatus of claim 1, further comprising at least one coupling, said at least one coupling designed to accommodate the plurality of pipes.

12. The apparatus of claim 11, wherein the apparatus comprises a plurality of couplings.

13. The apparatus of claim 12, wherein the plurality of couplings comprises at least one tee coupling and at least one right angle coupling.

14. The apparatus of claim 1, wherein the apparatus comprises polyvinylchloride.

15. A kit that comprises parts for assembling an apparatus, said apparatus configurable to clean a condenser on an HVAC system, said apparatus comprising a plurality of pipes, said plurality of pipes being assembled in a manner that the apparatus is ideally suited to deliver water and/or a cleaning liquid to the condenser at a pressure sufficient to clean the condenser, the plurality of pipes having at least one inlet that allows water to transverse the interior of said plurality of pipes and at least one sprayer, said at least one sprayer positioned so as to deliver the water and/or the cleaning liquid to every part of the condenser without moving the apparatus and wherein the inlet comprises a container configured to be removable and reattachable and to hold a cleaning liquid that can be mixed with water entering the apparatus.

16. The kit of claim 15, wherein the kit further comprises couplings and adhesive.

17. The kit of claim 16, wherein said couplings comprise at least one tee coupling and at least one right angle coupling.

18. A method of cleaning a condenser that has salt and/or soot on the condenser, said method comprising placing an apparatus over the condenser, said apparatus configurable to clean a condenser on an HVAC system, said apparatus comprising a plurality of pipes, said plurality of pipes being assembled in a manner that the apparatus is ideally suited to deliver water and/or a cleaning liquid to the condenser at a pressure sufficient to clean the condenser, the plurality of pipes having at least one inlet that allows water to transverse the interior of said plurality of pipes and at least one sprayer, said at least one sprayer positioned so as to deliver the water and/or the cleaning liquid to every part of the condenser without moving the apparatus thereby cleaning the condenser and wherein the inlet comprises a container configured to be removable and reattachable and to hold a cleaning liquid that can be mixed with water entering the apparatus.

19. The method of claim 18, wherein the apparatus has at least one valve that allows a user to shut off water to at least a part of the condenser.

20. The method of claim 18, wherein the method further comprises using the cleaning liquid to clean the condenser.

* * * * *